US009721690B2

(12) United States Patent
Franz et al.

(10) Patent No.: US 9,721,690 B2
(45) Date of Patent: Aug. 1, 2017

(54) MELTING DEVICE FOR CONSOLIDATING CONTAMINATED SCRAP

(71) Applicant: ALD VACUUM TECHNOLOGIES GMBH, Hanau (DE)

(72) Inventors: Henrik Franz, Freigericht (DE); Karl-Heinz Grosse, Gründau (DE); Markus Holz, Bruchköbel (DE); Michael Protzmann, Wächtersbach (DE)

(73) Assignee: ALD VACUUM TECHNOLOGIES GMBH, Hanau (DE)

( * ) Notice: Subject to any disclaimer, the term of this patent is extended or adjusted under 35 U.S.C. 154(b) by 144 days.

(21) Appl. No.: 14/761,357

(22) PCT Filed: Jan. 16, 2014

(86) PCT No.: PCT/EP2014/050812
§ 371 (c)(1),
(2) Date: Jul. 16, 2015

(87) PCT Pub. No.: WO2014/111474
PCT Pub. Date: Jul. 24, 2014

(65) Prior Publication Data

US 2015/0380118 A1 Dec. 31, 2015

(30) Foreign Application Priority Data

Jan. 17, 2013 (DE) ..... 10 2013 100 463

(51) Int. Cl.
*F27B 14/00* (2006.01)
*G21F 9/30* (2006.01)
(Continued)

(52) U.S. Cl.
CPC ..... *G21F 9/308* (2013.01); *F27B 14/04* (2013.01); *F27B 14/08* (2013.01); *G21F 9/008* (2013.01);
(Continued)

(58) Field of Classification Search
CPC ..... F27B 14/04
See application file for complete search history.

(56) References Cited

U.S. PATENT DOCUMENTS 4,227,033 A 10/1980 Nikolov
4,432,942 A 2/1984 Adachi
(Continued)

FOREIGN PATENT DOCUMENTS

DE 33 31 383 A1 3/1985
DE 34 04 106 A1 9/1985
(Continued)

OTHER PUBLICATIONS

Machine Translation of JP06273587A 0-1994.*

*Primary Examiner* — Scott Kastler
(74) *Attorney, Agent, or Firm* — Hudak, Shunk & Farine Co. LPA

(57) ABSTRACT

A mobile melting device for consolidating contaminated scrap and to a corresponding method. The melting device has a crucible chamber and a crucible base. The crucible is arranged on the crucible base during operation, and the crucible base and the crucible chamber together form a gas-tight furnace housing. It is thus possible to carry out the method in a vacuum or under protective gas such that even a reactive material can be consolidated. The melting device can be assembled and disassembled with little effort.

18 Claims, 5 Drawing Sheets

(51) Int. Cl.

| | |
|---|---|
| ***F27B 14/04*** | (2006.01) |
| ***F27B 14/08*** | (2006.01) |
| ***G21F 9/00*** | (2006.01) |
| *G21D 1/00* | (2006.01) |

(52) U.S. Cl.
CPC ..... *F27B 2014/0831* (2013.01); *G21D 1/003* (2013.01)

(56) References Cited

U.S. PATENT DOCUMENTS

| | | | | |
|---|---|---|---|---|
| 5,009,511 | A | 4/1991 | Sarko et al. | |
| 2015/0380118 | A1* | 12/2015 | Franz | F27B 14/08 164/61 |

FOREIGN PATENT DOCUMENTS

| | | | | |
|---|---|---|---|---|
| DE | 4409145 | A1 | | 9/1995 |
| DE | 69123609 | T2 | | 7/1997 |
| DE | 102004003518 | A1 | | 8/2005 |
| EP | 0394516 | A1 | | 4/1989 |
| FR | 1 357 744 | | | 4/1964 |
| FR | 2447592 | A1 | | 1/1980 |
| JP | 6-273587 | A | | 9/1994 |
| JP | 06273587 | A | * | 9/1994 |
| JP | 2005-16812 | A | | 1/2005 |

* cited by examiner

MELTING DEVICE FOR CONSOLIDATING CONTAMINATED SCRAP

FIELD OF THE INVENTION

The present invention relates to a melting device for consolidating contaminated scrap and a consolidation method that can be performed by use of the melting device.

BACKGROUND OF THE INVENTION

During the dismantling of nuclear plants, such as nuclear power plants, research centers, uranium enrichment plants and reprocessing plants contaminated scraps are accumulated which, for example, fall into the category "low level radioactive waste". These scraps may possibly be decontaminated by the remelting process and returned into the normal material cycle. Medium level contaminated scraps and high level radioactive scraps may also be accumulated. These scraps can no longer be returned into the normal material cycle and have to be disposed of in a repository. To keep costs of the repository as low as possible it is necessary to consolidate the volume of the accumulated scrap into a massive block by melting. The present invention describes a melting device and the associated method specifically tailored to this task.

During the dismantling of nuclear facilities process equipment, such as vessels, piping, fittings, meters, storage racks, linings and even metallic structural elements, such as platforms, scaffolds, stairs, etc., which are located in contaminated areas or come into contact with radioactive media have to be disposed in a repository. These components are cut during the dismantling by appropriate measures and are accumulated as a mixture of lump scrap and chips. The material is not in any case sorted, but is a mixture of different qualities, such as carbon steel, stainless steel, copper, brass, aluminum, magnesium, cadmium and others. When storing unconsolidated material many cavities would remain, which would considerably increase the repository volume and thus the costs. Furthermore, such scrap heaps provide a very large surface area, from which radionuclides could be carried off or released.

At present, for melting the scrap from nuclear plants melting devices are known which are designed as open air induction furnaces, in which the liquid melt is poured into molds. The inventors of the melting device according to the invention among others have identified the following restrictions in the solutions of the prior art:

- The exhaust gases from the plants are released into the room and have to be disposed by means of a complex emission purification system.
- The crucibles of these plants are made of refractory ceramic, are subjected to wear due to thermal and mechanical stress and have to be broken off after a melting campaign. In this process, the ceramic crucibles are destroyed and crushed in defined residual pieces. Thus, additionally large amounts of contaminated waste and dust are obtained as secondary waste.
- The nuclear controlled area of these plants is relatively large.
- Known plants are stationary plants to which the radioactively contaminated scrap has to be transported.
- Scraps containing reactive metals, such as magnesium, cannot be melted.
- Scrap components which develop harmful vapors, such as cadmium, can only be melted in a restrictive way.
- Volatile radioactive isotopes cannot be retained.

The dismantling of such plants is very complex.

The previously known melting facilities are all affiliated to central disposal centers where large controlled areas are established. This means that contaminated material has to be transported from the demolition site to the waste disposal centers, which increases the costs for a large transport volume of nuclear material.

DE 34 04 106 A1 describes a process for the recovery of metallic components of nuclear power plants. Disclosed is a crucible, which is introduced into the melting furnace. The melting furnace includes a furnace chamber with a furnace chamber bottom. However, the furnace is not hermetically sealed. Instead, a part of the resulting exhaust gas is sucked off by a suction hood. This melting furnace can therefore only be operated in a large safety area comprising means for preventing the contamination of the environment. Thus, the facility described therein cannot be used as a mobile unit.

DE 33 31 383 A1 describes a facility for the recovery of metallic components of nuclear power plants. The facility must be operated in a vacuum hall. Thus, the facility is neither sealed hermetically nor transportable.

Thus, numerous melting devices are known from the prior art. Common to all is that the melting devices are not transportable or are transportable only with a very large expense. Therefore, the scrap to be processed always had to be transported to the melting device. However, transports of radioactive materials are risky and regularly meet with resistance from the population.

SUMMARY OF THE INVENTION

It is the object of this invention to provide a melting device for reducing the volume of radioactively contaminated material, which makes it possible to significantly reduce the transport of radioactive material.

The object is achieved by the subject matter of the claims. The present invention provides an improved method by providing a novel mobile melting device and a method as defined in the claims. The invention provides a facility and a method capable of achieving a reduction in volume of such radioactively contaminated material as is obtained from the dismantling of nuclear facilities (hereinafter: "material to be to melted"). The facility can be operated economically and causes no risks to human health and the environment in operation.

DETAILED DESCRIPTION OF THE INVENTION

The melting device according to the invention is a mobile melting device comprising a crucible base and a crucible chamber which is suitable for receiving the crucible. The crucible base includes a chamber bottom and the crucible chamber comprises a shell. The melting device comprises a transport means which is capable to move the crucible base together with the crucible from a first position outside the crucible chamber to a second position within the crucible chamber (also: melting position). The chamber bottom and the shell are configured so that they together form a gas-tight furnace enclosure in the second position.

The crucible can thus be moved from a place outside the crucible chamber to a place within the crucible chamber and vice versa. In operation the transport means is preferably arranged below the crucible chamber so that the crucible can be lifted upwardly into the crucible chamber by means of the transport means. The transport means can be a scissor lift table. Alternatively, a lift table can be used, which is operated with feed shafts or hydraulic cylinders and a track guide.

The crucible is preferably arranged on the crucible base. The crucible is preferably made of a heat-resistant material, especially of ceramic, graphite, clay-graphite, or mixtures thereof. The crucible preferably has a cylindrical shape, wherein the lateral surface of the cylinder is limited by a crucible wall and the base area is limited by a crucible bottom. The crucible may be moved from the second position to the first position by use of the transport means. Thereby, the crucible and the crucible base on the one hand become accessible for maintenance purposes and on the other hand the removal of the crucible with its contents is facilitated. Then the crucible can be removed from the crucible chamber and another crucible can be introduced into the crucible chamber. Thus, a high utilization of the facility is possible, without having to await long cooling periods. Thus, the crucible is preferably an exchangeable crucible. Due to the relatively thin crucible walls and the relatively thin crucible bottom, which in operation are preferably reinforced by stabilizing elements or a base plate, respectively, the crucible can relatively easily be handled. In the case of a defective crucible it can be disposed while no large amounts of additional waste are obtained.

A component of the crucible base is preferably a bottom plate, on which the crucible can be arranged. The bottom plate reinforces the crucible. In this way the crucible bottom is supported, without the crucible thereby becoming heavier. The bottom plate is preferably thicker than the crucible bottom in order to ensure a sufficient stability. In preferred embodiments the bottom plate is more than twice as thick as the crucible bottom. The bottom plate is preferably made of a heat resistant material, in particular of ceramic.

The crucible base preferably comprises a collecting pan. The collecting pan serves to collect escaping melt if the crucible is damaged. If the melt escapes due to a crucible damage the melt is disposed in the collecting pan within the transportable crucible base and is carried out by means of the transport means. Thus, the melting device can continuously be operated without maintenance. Only the crucible base has to be processed. The collecting pan is preferably made of a refractory material.

The shell preferably constitutes the outer shell of the crucible chamber. The shell helps to make the furnace enclosure gas-tight. For this purpose, the shell is a closed shell. However, it comprises at least one opening for introducing the crucible, and preferably at least one chamber opening for recharging material to be melted. Furthermore, it may comprise one or more openings for passing through leads for the heater. In addition, it may comprise an opening that allows the connection of a suction device. The shell is preferably made of metal, in particular steel.

The chamber bottom is configured such that together with the shell it forms a gas-tight furnace enclosure. It is preferably made of the same material as the shell. The chamber bottom preferably seals the crucible base downwardly. The other components of the crucible base, in particular the bottom plate and the collecting pan, are disposed inside the chamber bottom, i.e. on the side facing to the crucible chamber in the melting position. At the place where the chamber bottom and the shell abut each other preferably at least one sealing element is arranged. The sealing element seals the furnace enclosure. It is preferably a lip seal made of a rubber-elastic material.

The crucible chamber is formed so that it can accommodate the crucible. The crucible is then preferably stabilized by stabilizing elements arranged within the crucible chamber during the melting process. The stabilizing elements are configured such that they relieve the crucible wall with respect to the hydrostatic pressure of the melt when the crucible is disposed inside the crucible chamber. Thus, in the melting position the stabilizing elements are located between the crucible and the shell. The stabilizing elements preferably form a common contact area with the bottom plate. The stabilizing elements are particularly resistant in order to withstand the high loads occurring during the melting process. The stabilizing elements are preferably configured such that they can be withdrawn if the crucible is to be removed from the melting position. Thus, the shape of the stabilizing elements is adapted to the shape of the crucible wall.

The melting device further comprises a heater adapted to heat the material disposed in the crucible. The heater is in particular a part of the crucible chamber. The heater is preferably an induction heater and/or a resistance heater. The heater is preferably a part of the crucible chamber. The heater is preferably arranged at a minimum distance from the crucible, so that even in cases of escaping melt there is no risk of any contact between the heater and the melt. In one embodiment, the heater is an induction heater. This has the advantage that the material to be consolidated can be heated very quickly, because the heat is generated directly in the crucible. In another embodiment, the heater is a resistance heater. This has the advantage that no cooling water has to be used in the vicinity of the melt. This minimizes the risk of a steam explosion. The heater is preferably disposed substantially within the shell, except for the leads to the heater.

Furthermore, the melting device according to the invention preferably comprises a charging device which is suitable to charge the scrap to be consolidated into the crucible. The charging device is preferably arranged above the crucible chamber in operation, so that the material to be melted can be discharged from the top into the crucible chamber and thus into the crucible. This process can be carried out by remote control, so that contamination risks are avoided. In order to be able to charge the crucible in the melting position, the shell of the crucible chamber preferably comprises a chamber opening. The chamber opening is preferably arranged in the upper region of the shell. The chamber opening can be closed by any closure element such as a lid. Preferably, a sluice which is also part of the crucible chamber is disposed on the chamber opening.

The sluice is preferably hermetically sealed. Thus, the material to be consolidated can be discharged into the crucible, without any dust and vapors escaping into the room. The sluice is part of the crucible chamber. The charging of the crucible is implemented through the sluice when the crucible is in the melting position, i.e. when the shell and the chamber bottom together form a gas-tight furnace enclosure. In this way and by means of the hermetically sealed sluice material to be melted can be discharged into the crucible without contaminating the environment. The sluice is then placed between the gas-tight furnace enclosure and the charging device.

The charging device may, for example, comprise a crane that can swivel a charging basket to an area above the chamber opening. There the charging basket can be lowered, so that the material to be melted passes through the chamber opening into the crucible. Other charging devices are contemplated, too. In particular, a movable charging cart is conceivable which can be moved preferably on rails from a position above the chamber opening to a receiving position.

The charging cart can be equipped with a cable pull system so that a charging basket can be pulled upwardly at the receiving position, for example, from a position at ground level next to the transport device, and the charging process of the crucible can be carried out at a position above the chamber opening. The charging cart, the rails and the cable pull system are then part of the charging device.

The charging cart is preferably provided with a housing, into which the charging basket can be guided. Thus, also the charging cart can be hermetically sealed. The housing of the charging cart can be configured such that it is flush with the upper end of the sluice so that during the discharge of the material to be melted into the sluice no dusts or vapors can escape.

The melting device according to the invention preferably comprises an exhaust gas purification system. This system can be connected to the crucible chamber via a connecting element, e.g. a pipe. The exhaust gas purification system may be a part of the chamber module or of the charging module, if present. However, it can also be arranged separately.

Preferably the melting device comprises a vacuum pump which is adapted to evacuate the gas-tight furnace enclosure. The vacuum pump can be connected to the crucible chamber via a connecting element, e.g. a pipe. In one embodiment an exhaust gas purification system is located downstream of the vacuum pump. From the exhaust gas purification system the exhaust gas can be fed into an exhaust gas disposal system, which typically already exists in nuclear facilities.

A preferred melting device according to the invention is a stationary furnace system, into which the crucible on the crucible base can be driven from below and locked. In addition, a charging device is preferably provided which operates with a hermetically sealed sluice. In this way a complete remote control of the melting device is enabled in connection with a video surveillance of the melting room.

The melting device according to the invention is configured as a mobile system which at the place where, for example, a nuclear plant is dismantled, can be set up temporarily in an already existing building with a nuclear control area. Auxiliary systems for operating the melting device can be disposed in containers that can be placed outside the control area. Such auxiliary systems are for example the melting power supply, the cooling water distribution, the process gas supply and the electric switchboard with the control panel.

After completion of the work this melting device according to the invention can be disassembled again and transported to another place of use, because it has preferably a modular design.

"Modular design" in this context means that the melting device can be easily disassembled into parts or assemblies that each can be suitably transported individually. The construction of the melting device meets the concerns for a transportable system also in that it can be brought into a state in which those parts of the melting device, which may come into contact with radioactive material are encapsulated. Here, auxiliary systems required are already disposed in appropriate transport containers and the modules of the melting device can easily be placed in a transport container. Thus, a burden on people and the environment during the transportation is reliably prevented. Melting devices according to the prior art cannot be disassembled at a reasonable cost. In addition, their disassembly would involve a high risk of contamination for the workers responsible for the disassembly.

Thus, the melting device according to the invention preferably comprises a plurality of modules. These are preferably at least one chamber module, a charging module and a transport module. In the modules some components are combined respectively so that each module by itself can easily be transported.

Thus, the melting device preferably comprises at least one chamber module. The chamber module is the most important module, because the actual melting process takes place therein. The chamber module comprises the crucible chamber. The charging module includes at least the charging device. The transport module comprises at least the transport means.

The crucible base is not part of the said modules, but is transported separately. The melting device according to the invention can be operated with several different crucible bases. Thus, subsequently to a melting process a crucible base with the crucible disposed thereon may be removed from the crucible chamber and immediately afterwards another crucible base with another crucible thereon can be introduced into the crucible chamber. This permits a particularly economically procedure.

In order to optimize the process flow the transport module can also be configured such that the transport device can be moved on a rail system. Such an embodiment is preferably configured so that a crucible base with a crucible can be loaded with a crucible at a loading position, is then moved to the first position below the crucible chamber, is then lifted into the melting position, is lowered again to the first position after the melting process and is finally brought to an unloading position. This has the advantage that already during the melting process occurring in the first crucible a second crucible can be loaded at the loading position. Once the content of the first crucible is melted and the first crucible base with the first crucible has been moved to the unloading position, the second crucible base with the second crucible can be brought into the melting position. Thus, two crucible bases can be used simultaneously.

After the transport of the melting device the modules can be easily reconnected to each other in order to set up the melting device. Herein, the transport module is preferably positioned below the chamber module. The charging module is preferably arranged above the chamber module. In order to make the modules easily transportable they are preferably provided with support elements. The support elements reinforce the modules and secure the individual components within a module against damage during the transport. The support elements can e.g. be steel beams.

The size of the individual modules is preferably chosen so that they can easily be transported. Prior to the transport, for example, the chamber module is separated from the transport module and optionally the charging module and shipped separately. Preferably, the modules are configured so that they can be readily loaded onto trucks or wagons. Advantageous embodiments are directed to modules that are sized so that they can be loaded into 20-foot standard containers or 40-foot standard containers. This means that each of the modules is preferably not longer than 5.71 m, not wider than 2.352 m and not higher than 2.385 m. The mass of each of the modules should preferably not exceed a value of 20000 kg, preferably 10000 kg, and more preferably 5000 kg.

The method according to the invention comprises the following steps:

a. charging the crucible with the material to be melted;
b. heating the material to be melted within the crucible;
c. optionally recharging an additional portion of material to be melted in the crucible;

d. solidifying the molten material in the crucible to form a block.

The charging of the crucible can be performed by means of a charging device which is preferably arranged above the crucible chamber. Alternatively, the crucible can also be charged at least partially outside the crucible chamber. The crucible is then transferred into the crucible chamber together with the material to be melted. After this first batch has been melted, one or more further batches can be recharged by use of the charging device. Thus, the crucible volume can be utilized optimally. If necessary, the melting device is set up prior to the charging of the crucible. The initial charging may thus take place outside the melting position (i.e. outside the crucible chamber), for example, at a loading position in a scrap storage. Here, the charging of the crucible with a sheet metal barrel is conceivable in which the material to be melted is contained. Thus, a damage of the crucible can be avoided. Finally the sheet metal barrel is melted together with the material to be melted.

During the charging by use of the charging device the material to be melted is thus charged into the crucible located in the gas-tight furnace enclosure through a chamber opening, for example, by means of a charging basket. For this purpose, the charging basket may be lowered and then its contents can be introduced into the crucible. At this time, the crucible may already contain molten material. The chamber opening can be configured as a sluice.

Depending on the process control the crucible can already include scrap to be consolidated when it is introduced into the crucible chamber. By means of the charging device then further material to be melted can be recharged in order to achieve a higher filling degree of the crucible. The method according to the invention preferably includes the step of recharging of material to be melted, after a first batch of material to be melted has already been melted in the crucible. By means of the melting process the volume of the material is reduced so that the crucible offers space for another batch of material to be consolidated.

The material to be melted is preferably heated to temperatures of at least 1000° C., more preferably at least 1350° C., and particularly preferably at least 1500° C. Of course, the selected temperature depends on the material to be melted. After heating the material to be melted is kept at the high temperature for a certain time so that the material melts as completely as possible. The melting process, which begins with the heating and ends immediately prior to the solidification, preferably lasts at least 4 hours and more preferably at least 6 hours. If a too short time period is chosen, the melt is possibly not complete. In addition, a too rapid heating should be avoided, since then local overheating can occur in or at the crucible, which would stress the crucible too much. Furthermore, this may cause a too strong convection which would also enhance the crucible erosion. Thus, the service life of the crucible would decrease.

However, it has been found that a melting time of 16 hours, in particular 10 hours, need not be exceeded because the melt is then complete and a shorter melt period due to the lower cost is always advantageous. Even if high-melting components are present in the material to be melted which do not yet melt at the temperatures mentioned, the voids in the material would still be filled by lower melting material.

The melting of the material to be melted is carried out within the crucible when it is disposed at the melting position, i.e. within the gas-tight furnace enclosure. In this position the melting device is configured so that the crucible chamber and the crucible base form a gas-tight furnace enclosure by means of the shell and the chamber bottom. Thus, the melting process can be conducted under vacuum or in an inert gas atmosphere, wherein an oxidation of the material to be melted is prevented. Thereby even reactive metal scraps can be consolidated which, for example, contain magnesium or cadmium. In addition, less volatile products are formed.

Before the crucible is removed, preferably the inert gas and possibly byproducts of the melt contained therein are sucked off and are preferably subjected to an exhaust gas purification. The exhaust gas purification can be performed by use of an exhaust gas purification system, which may be a condensation trap. Other purification methods are conceivable, too, for example filtering, in particular by use of HEPA filters.

Contaminations of the material to be melted can be removed by a vacuum-thermal pre-treatment in the crucible. These are, for example, moisture, solvents, varnishes, oils, fats and/or plastics.

The process is preferably carried out depending on the material specific requirements under vacuum or under an inert gas. This ensures that reactive components of the material to be melted form no explosions or volatile oxides, which cannot be excluded in working under an air atmosphere.

The chamber opening is preferably closed by a closure element during the melting process. The closure element can be part of a sluice which allows to charge the material to be melted into the crucible without contamination of the environment by the crucible contents. This measure contributes to the fact that the security area around the melting device can be kept very small. Moreover, material to be melted can be recharged during the operation, if due to the consolidation of a first scrap portion a volume contraction has occurred. Thus, even during the recharging the vacuum or an inert gas atmosphere is maintained within the furnace enclosure.

The solidification of the molten material is preferably carried out while the crucible is located within the furnace enclosure. Here, the material already cools at least partially and forms a block. It is not necessary that the block is cooled in this position to ambient temperature. It is sufficient if it cools to such an extent that it can be removed safely. Cooling to room temperature is then preferably carried out at a different place, for example, at the above mentioned unloading position. In the meantime, already another crucible, optionally on another crucible base may be introduced into the crucible chamber.

The block may be removed from the crucible or can be disposed together with the crucible. Prior to removal of the block from the crucible the crucible is moved by means of the transport means from the second position to the first position outside the crucible chamber. It is preferable that the crucible is lowered from the second position to the first position. This means that the crucible is removed from the crucible chamber in a downward movement. The crucible can then be removed from the area below the crucible chamber. This can be done by means of the transport means or by use of a separate further transport means. In a particular embodiment, the transport means with the crucible base and the crucible arranged thereon is movable, in particular on rails. Because the crucible is removed from the area below the crucible chamber another crucible can be introduced into the crucible chamber. This makes it possible to utilize the residual heat in the crucible chamber and to utilize the melting device appropriately. During cooling at the unloading position, the block removal and the reloading in the loading position, a new melting process can already be carried out with a further crucible.

Furthermore, the melting device has the advantage that in case of a crucible failure the melt can be discharged into a collecting pan present in the crucible base. There, the melt can solidify. The crucible base with the defective crucible can then be removed from the crucible chamber and the consolidation process can be continued with another crucible on another crucible base.

During the melting process a substantially oxygen free atmosphere prevails within the crucible chamber. This means that the oxygen partial pressure prevailing there is less than 10 kPa, more preferably less than 1 kPa. This can be achieved either by a vacuum or an inert gas atmosphere within the crucible. A preferred inert gas is nitrogen because it effectively suppresses the formation of volatile oxides and is inexpensive.

Because a high utilization due to the use of exchangeable crucibles is possible the melting device can be smaller in its dimensions with the same throughput than is the case with other systems. This in turn facilitates the transport. In addition, the crucible and thus the entire melting device can be constructed more lightweight, because after each melting process an inspection of the crucible is possible. In conventional melting devices the crucibles were configured extremely robust because they were partly used in a continuous operation, which allows no inspections during the process.

After completion of the melting process the molten material can solidify in the crucible, so as to form a block having no voids and thus a significantly higher density compared to the starting material.

After cooling of the block, preferably within the crucible, the block can be removed from the crucible and transferred, for example, to a standardized waste package (e.g. a metal sheet barrel). The crucible is thus preferably configured such that a block is obtained which fits into a standard waste package. The block is preferably a cylindrical body with a diameter of about 400 to 600 mm and a height of about 800 to 1000 mm.

Crucibles, which have reached the end of their life, can be provided together with the solidified block in a likewise standardized larger waste package for the final disposal without destroying the crucible.

The tightness of the furnace enclosure and the charging device can be verified and thus ensured at any start of a new consolidation melt, i.e. preferably prior to heating, by a short pressure rise test. The furnace enclosure is preferably hermetically sealed. This means that the pressure rise at a vacuum of 20 mbar for 1 hour is less than 20 mbar. The same preferably applies also for the sluice and in particular for the charging device.

The method according to the invention is further characterized in that the steps of charging, heating, melting, and optionally recharging and solidifying into a block for a batch of material to be melted take place within a single exchangeable crucible preferably under vacuum and/or a controlled atmosphere. The preferably metallic block can be used later optionally after a further modification for the final disposal or storage. An inventive feature of the method is that the melt is not poured out of the crucible.

The melting device according to the invention offers a number of advantages over conventional melting devices:

Untreated nuclear scraps need not be transported on public traffic routes, because the mobile melting device can be transported to the material to be consolidated.

The solidified block of consolidated material can be introduced directly into a repository storage container and no additional molds are required.

The melting, recharging and solidifying of the block are carried out in a hermetically sealed furnace enclosure with substantial exclusion of oxygen, and thus a release of vapors and dusts into the controlled area is prevented.

The vapors and dusts can be retained in an exhaust gas purification system.

The melting device is preferably configured such that in the event of a crucible failure the escaping melt is safely discharged into a preferably uncooled collecting pan without the risk of a steam explosion or pollution of the environment.

The refractory material of the crucible does not have to be broken off, so there is no secondary waste and the control area is accordingly reduced.

The system uses an already existing on-site control area, thus there arise no additional dismantling costs.

DESCRIPTION OF THE FIGURES

The following description of the figures relates to a preferred embodiment of the melting device and its components.

Figure 1:
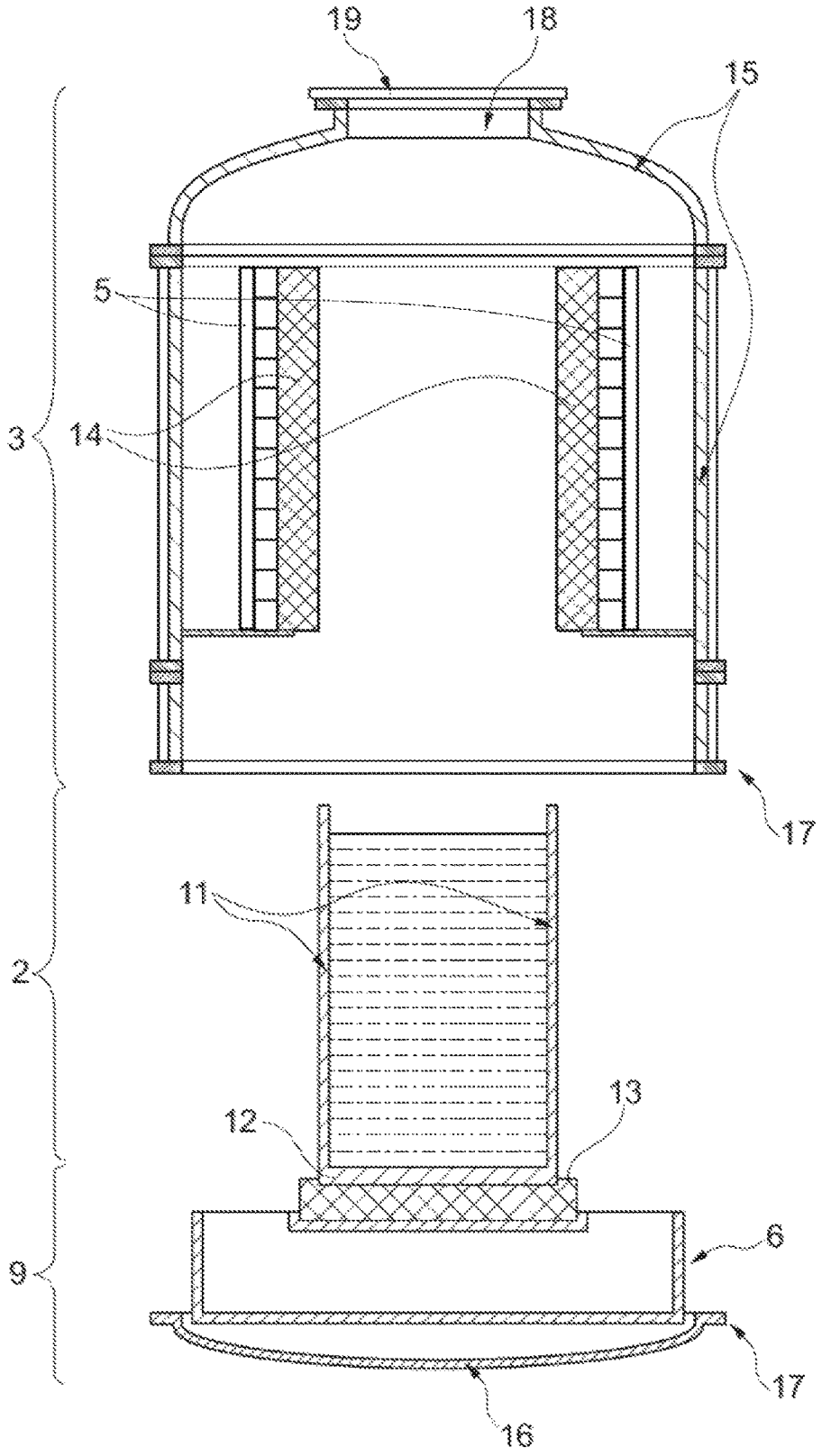
FIG. 1 shows a sectional view of the crucible chamber 3 and the crucible 2 including the crucible base 9 in the first position, i.e. the crucible 2 is located outside the crucible chamber 3. The crucible base 9 is arranged below the crucible 2 and comprises a collecting pan 6 which is adapted to receive molten material, if the crucible 2 should become leaky. In the position shown, the crucible 2, the crucible chamber 3 and the crucible base 9 can be serviced.

The crucible 2 comprises a crucible wall 11 and a crucible bottom 12 which consist of a refractory material, in particular graphite, clay-graphite or ceramic. The crucible wall 11 and the crucible bottom 12 are configured relative thin. This has the advantage that the mass of the crucible 2 is lower than that of conventional crucibles. This facilitates the handling of the crucible 2. The crucible attains the necessary stability to withstand the high loads occurring during operation in particular by a bottom plate 13 which is arranged below the crucible bottom 12, and by stabilizing elements 14 which form a part of the crucible chamber 3. The stabilizing elements 14 can be withdrawn after the melting process in order to be able to lower the crucible 2.

The crucible chamber 3 further comprises a shell 15, which preferably represents the outer boundary of the crucible chamber 3.

The crucible base 9 comprises a chamber bottom 16 which is configured such that it constitutes a hermetically sealed space together with the shell 15 of the crucible chamber 3, when the crucible base 9 is in the second position.

In order to achieve the required hermetic seal sealing elements 17 which serve to form a gas-tight furnace enclosure when the chamber bottom 16 closes the crucible chamber 3 are arranged at the lower edge of the shell 15 and at the upper edge of the chamber bottom 16.

In the upper region of the crucible chamber 3 there is a chamber opening 18 which is adapted to charge material to be melted into the crucible 2. The chamber opening 18 can be closed by a closure element 19, which may be part of a sluice.

Figure 2:
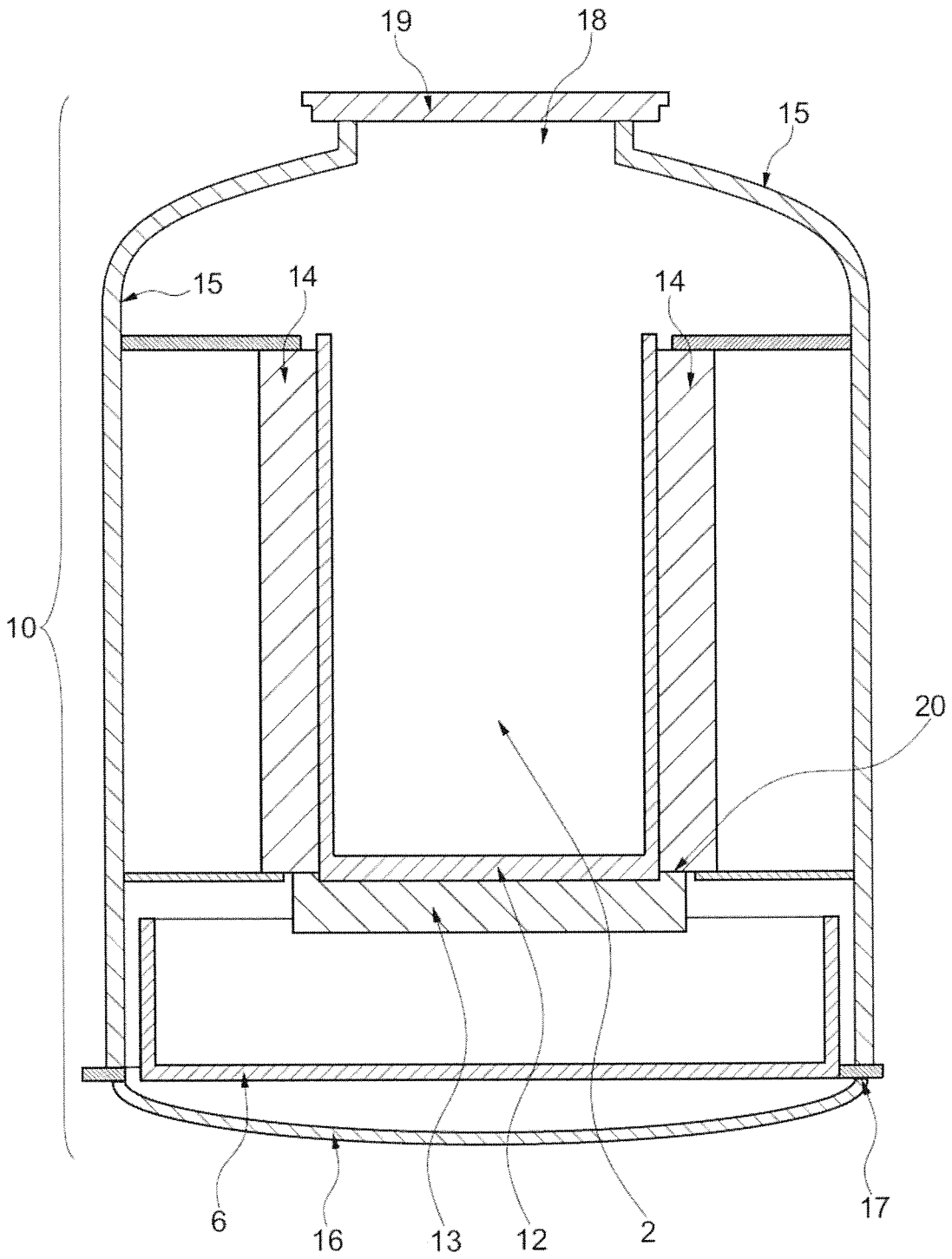

FIG. 2 is likewise a sectional view showing how the chamber bottom 16 together with the shell 15 forms a gas-tight furnace enclosure 10, when the crucible 2 by use of the transport device (not shown) has been brought into the second position (melting position). The sealing elements 17 provide a hermetic seal of the gas-tight furnace enclosure 10. The closing element 19, too, is preferably configured gas-tight.

It can be seen that the bottom plate 13 with the stabilizing elements 14 has formed common contact areas 20. Thus, the crucible 2 is stabilized during the consolidation process. However, if the crucible 2 nevertheless should be damaged, which results in a leakage of the melt, the collecting pan 6 would collect the melt. Then, the melt would be enclosed safely in the gas-tight cell 10 because neither the shell 15 nor the chamber bottom 16 can be adversely effected thereby. In such a case one could wait until the leaked melt has been solidified in the collecting pan 6 and can be removed safely. While the leaked melt continues to cool down in the collecting pan 6 another crucible on another crucible base can already be introduced into the crucible chamber 3 and the consolidation process can be continued.

Figure 3:
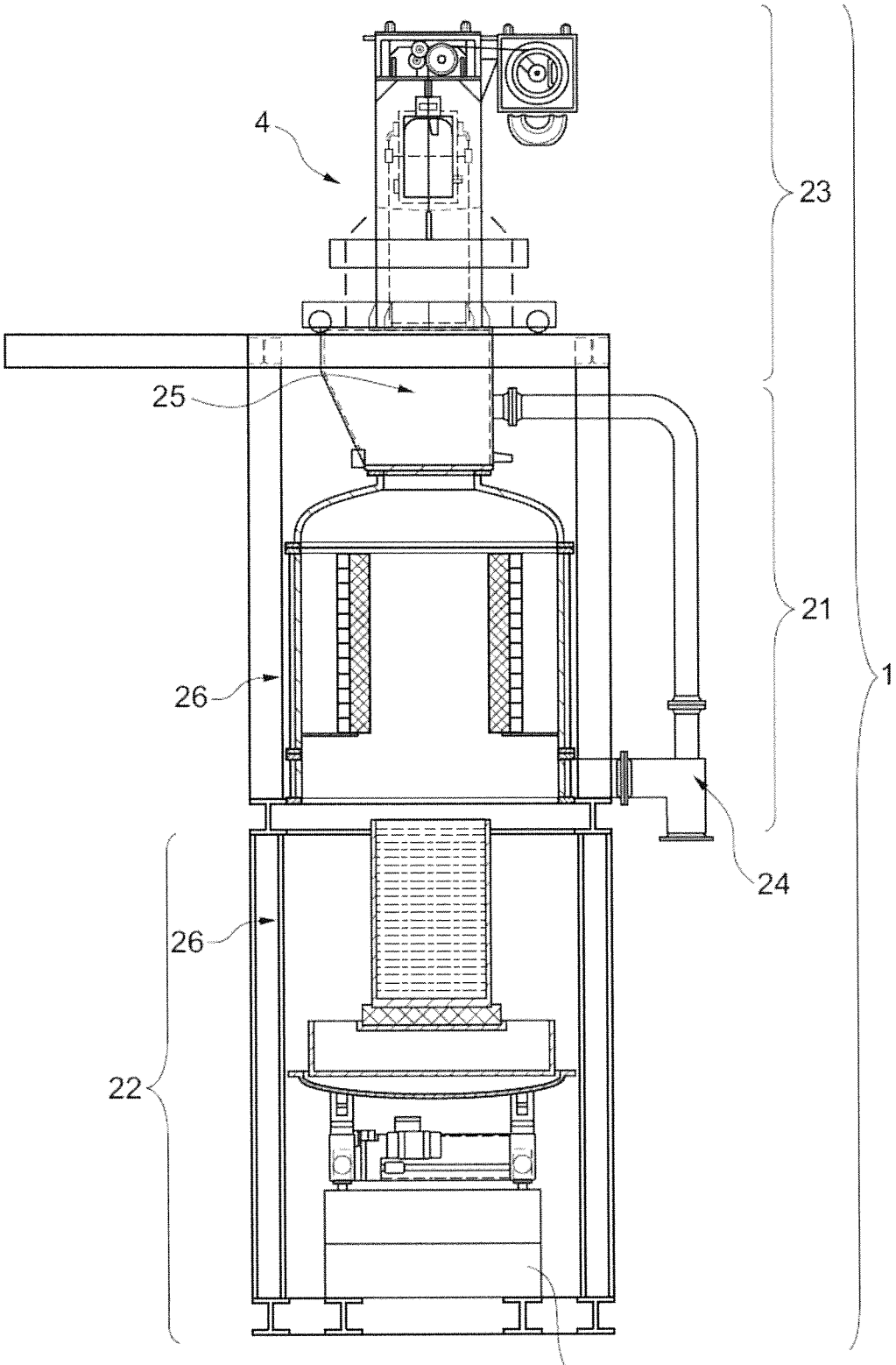

FIG. 3 is a sectional view showing a mobile melting device 1 of the present invention. It can be seen that the melting device has a modular configuration. The chamber module 21 is disposed above a transport module 22. Above the chamber module 21 a charging module 23 is shown. The modules are configured such that they can easily be separated from each other at a dismantling of the plant and shipped separately.

It can be seen that the chamber module 21 comprises, inter alia, the crucible chamber 3 with its components. In this figure, also a connecting element 24 is shown, which connects the crucible chamber 3 and a sluice 25 with an exhaust gas purification system and/or a vacuum pump (not shown).

The base module 22 comprises the transport means 7, which in the present case is a scissor lift table.

It is well recognized that the individual modules are stabilized by support elements 26, which here are configured as steel beams. As a result, the modules attain a shape and a stability which simplify the transport and also reduce the complexity of the assembly of the melting device.

Moreover, a charging module 23 is shown, which is connected via a sluice 25 with the crucible chamber 3. The charging module 23 includes the charging device which comprises a charging cart including a housing movable on rails.

Figure 4:
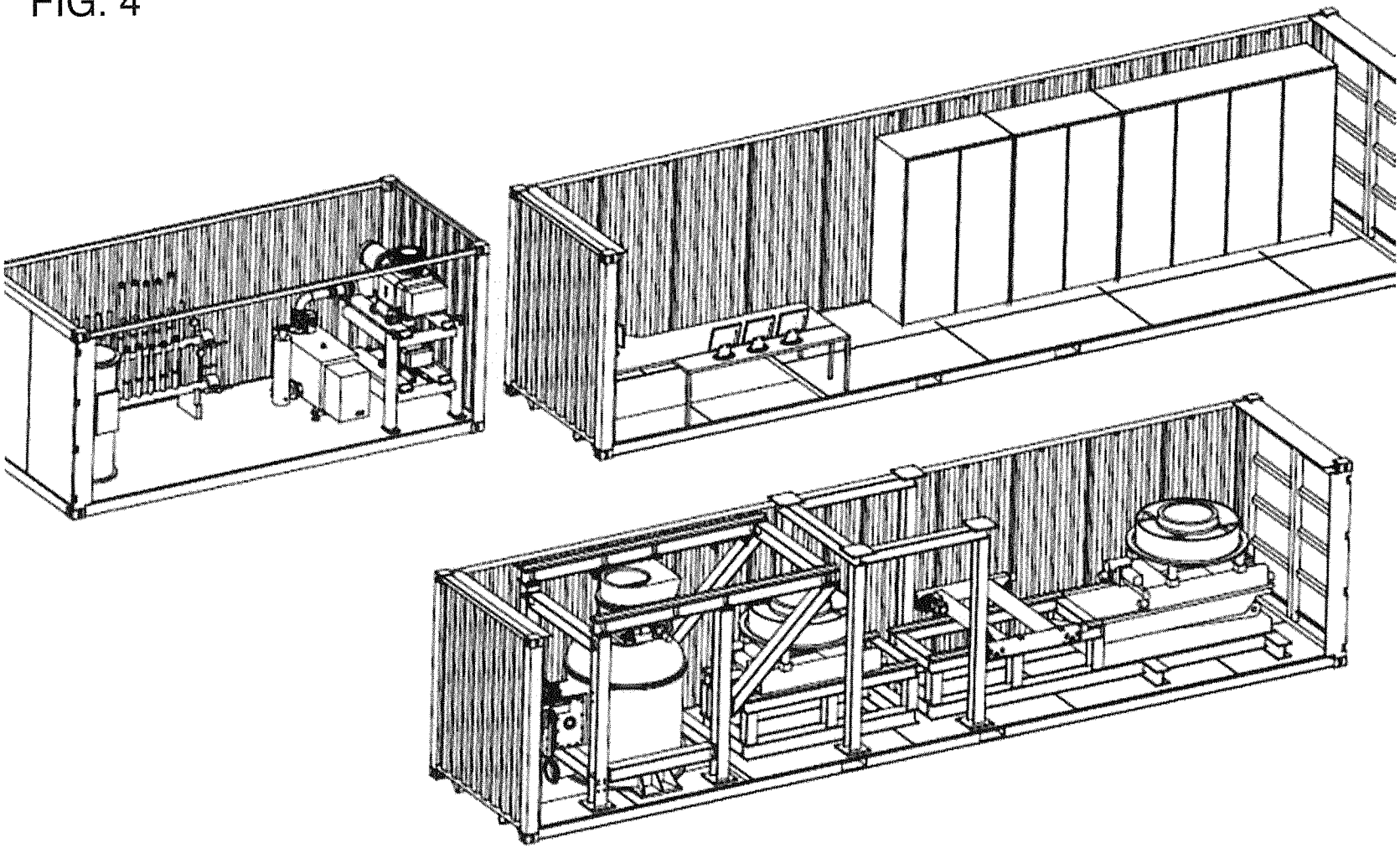

FIG. 4 shows the mobile melting device in a state ready for shipping.

Figure 5:
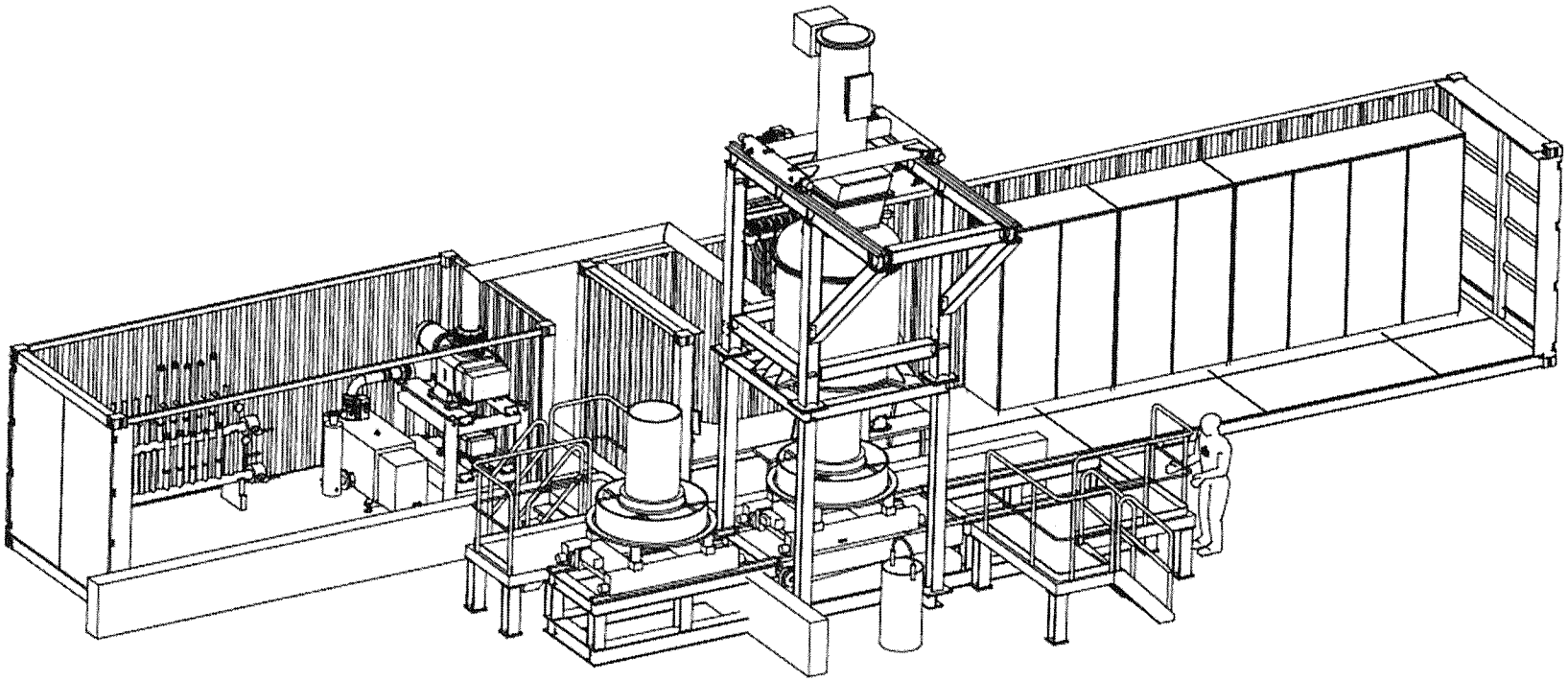

FIG. 5 shows two views of a set-up mobile melting device with auxiliary systems.

LIST OF REFERENCE SYMBOLS

1 mobile melting device
2 crucible
3 crucible chamber
4 charging device
5 heater
6 collecting pan
7 transport means
8 block
9 crucible base
10 gas-tight furnace enclosure
11 crucible wall
12 crucible bottom
13 bottom plate
14 stabilizing element
15 shell
16 chamber bottom
17 sealing element
18 chamber opening
19 closure element
20 contact area
21 chamber module
22 transport module
23 charging module
24 connecting element
25 sluice
26 support element

What is claimed is:

1. A mobile melting device including a crucible base and a crucible chamber adapted to receive a crucible; comprising: the crucible base comprises a chamber bottom and the crucible chamber comprises a shell, wherein the device further comprises a transport means which is adapted to move the crucible base together with the crucible from a first position to a second position, wherein the crucible in said first position is disposed outside the crucible chamber and in the second position is disposed within the crucible chamber, wherein the chamber bottom and the shell are configured such that they form a gas-tight furnace enclosure in the second position, wherein the transport means with the crucible base and the crucible arranged thereon is movable such that crucible can be removed from the area below the crucible chamber and another crucible can be introduced into the crucible chamber, wherein the melting device comprises a charging device which is arranged above the crucible chamber, and wherein stabilizing elements are arranged within the crucible chamber, stabilizing the crucible during the melting process.

2. The melting device according to claim 1, wherein the charging device is gas-tight.

3. The melting device according to claim 1, wherein the crucible chamber comprises a heater that enables to heat the crucible.

4. The melting device according to claim 1, comprising a collecting pan which is arranged below the crucible in the crucible base.

5. The melting device according to claim 1, wherein the melting device is configured modular, comprising at least one chamber module, a charging module and a transport module.

6. A method for consolidating a material in a melting device according to claim 1, comprising the steps of a. charging a crucible with a material to be consolidated;

b. heating the material to be melted within the crucible, so that at least a part of the material to be melted melts, c. recharging an additional portion of material to be melted, and d. solidifying the molten material in the crucible to a block.

7. The method according to claim 6, wherein a non-oxidizing atmosphere prevails in the crucible chamber during the heating process.

8. The method according to claim 6, wherein the crucible during the process steps of heating, melting, recharging and solidifying is disposed within the crucible chamber.

9. The method according to claim 6, wherein the crucible is removed from the crucible chamber and cooled after the solidification and another crucible is introduced into the crucible chamber during the cooling process.

10. The method according to claim 6, wherein the oxygen partial pressure in the crucible chamber is less than 10 kPa.

11. The method according to claim 6, wherein the steps of charging, heating, melting and, optionally recharging, are carried out in a single crucible under vacuum and/or a controlled atmosphere.

12. The melting device according to claim 1, comprising stabilizing elements arranged within the crucible chamber to stabilize the crucible during the melting process.

13. The melting device according to claim 3, wherein the heater is an induction heater.

14. A mobile melting device including a crucible base and a crucible chamber adapted to receive a crucible; comprising: the crucible base comprises a chamber bottom and the crucible chamber comprises a shell, wherein the device further comprises a transport means which is adapted to move the crucible base together with the crucible from a first position to a second position, wherein the crucible in said first position is disposed outside the crucible chamber and in the second position is disposed within the crucible chamber, wherein the chamber bottom and the shell are configured such that they form a gas-tight furnace enclosure in the second position, wherein the transport means with the crucible base and the crucible arranged thereon is movable such that crucible can be removed from the area below the crucible chamber and another crucible can be introduced into the crucible chamber, wherein the melting device comprises a charging device which is arranged above the crucible chamber, and wherein the melting device comprises a collecting pan which is arranged below the crucible in the crucible base.

15. The melting device according to claim 14, wherein the charging device is gas-tight.

16. The melting device according to claim 14, wherein the crucible chamber comprises a heater that enables to heat the crucible.

17. The melting device according to claim 14, wherein the melting device is configured modular, comprising at least one chamber module, a charging module and a transport module.

18. A method for consolidating a material in a melting device according to claim 14, comprising the steps of a. charging a crucible with a material to be consolidated;

b. heating the material to be melted within the crucible, so that at least a part of the material to be melted melts, c. recharging an additional portion of material to be melted, and d. solidifying the molten material in the crucible to a block.

* * * * *